US007580541B2

(12) United States Patent
Hlas et al.

(10) Patent No.: US 7,580,541 B2
(45) Date of Patent: Aug. 25, 2009

(54) PERSONAL AUDIO-SET WITH ADJUSTABLE SLIDING EAR CLIP MOUNT

(75) Inventors: Kevin Hlas, Portland, OR (US); Alex Danielson, Forest Grove, OR (US); Bernhard Wildner, Portland, OR (US); Omer Kotzer, Portland, OR (US); Jamian Cobbett, Portland, OR (US)

(73) Assignee: Logitech Europe S.A., Romanel-sur-Morges (CH)

( * ) Notice: Subject to any disclaimer, the term of this patent is extended or adjusted under 35 U.S.C. 154(b) by 0 days.

(21) Appl. No.: 11/218,910

(22) Filed: Sep. 1, 2005

(65) Prior Publication Data

US 2006/0291686 A1 Dec. 28, 2006

Related U.S. Application Data

(63) Continuation of application No. 11/031,695, filed on Jan. 7, 2005, now abandoned.

(60) Provisional application No. 60/535,055, filed on Jan. 7, 2004.

(51) Int. Cl.
*H04R 25/00* (2006.01)

(52) U.S. Cl. ..... 381/381; 381/374; 381/330

(58) Field of Classification Search ..... 381/309, 381/330, 370, 374, 375, 376, 378, 380, 381; 379/430, 420.01, 420.02, 420.04; 181/129, 181/130, 135

See application file for complete search history.

(56) References Cited

U.S. PATENT DOCUMENTS 2,474,135 A * 6/1949 White ..... 381/381
4,453,050 A 6/1984 Enokido
5,446,788 A * 8/1995 Lucey et al. ..... 379/430
5,544,253 A 8/1996 Nagayoshi et al.
5,625,171 A 4/1997 Marshall
5,708,724 A * 1/1998 Burris et al. ..... 381/370
6,377,697 B1 4/2002 Cheng
2002/0106100 A1 8/2002 Kao

OTHER PUBLICATIONS

International Search Report; PCT app. No. PCT/US05/00550; Jan. 7, 2005; 3 pages.
Written Opinion of the International Searching Authority; PCT app. No. PCT/US05/00550; Jan. 7, 2005; 4 pages.
Notification of Transmittal of International Search Report and Written Opinion; PCT app. No. PCT/US05/00550; Jan. 7, 2005; 1 page.
International Preliminary Report on Patentability; PCT app. No. PCT/US2005/000550; Jan. 16, 2007; 5 pages.
Notification Concerning Transmittal of Copy of International Preliminary Report on Patentability; PCT app. No. PCT/US2005/000550; Jan. 25, 2007; 1 page.

* cited by examiner

*Primary Examiner*—Huyen D Le
(74) *Attorney, Agent, or Firm*—Townsend and Townsend and Crew LLP

(57) ABSTRACT

A personal audio set formed that includes an ear-clip mounting portion pivotally secured to a frame is disclosed. In one embodiment, the frame of the personal audio set includes a sliding portion to define a first axis of rotation, and the ear hook is pivotally secured to the sliding portion to define a second axis of rotation so that the headset may be properly worn on either the wearer's left or right ear by moving the sliding portion and ear hook about their respective axes. The ear hook is preferably substantially c-shaped and dual molded.

14 Claims, 9 Drawing Sheets

26
104
12
42
60
10
106

A
B
B1
106
A1
12
104
10
26
60
10

100
12
10
104
42
26
60
100

42
10
10
106
104
12

60
26
B
106
104
12
B1

10
12
B
104
60
26
86
10'
106

60
26
42
10'
10
12
86

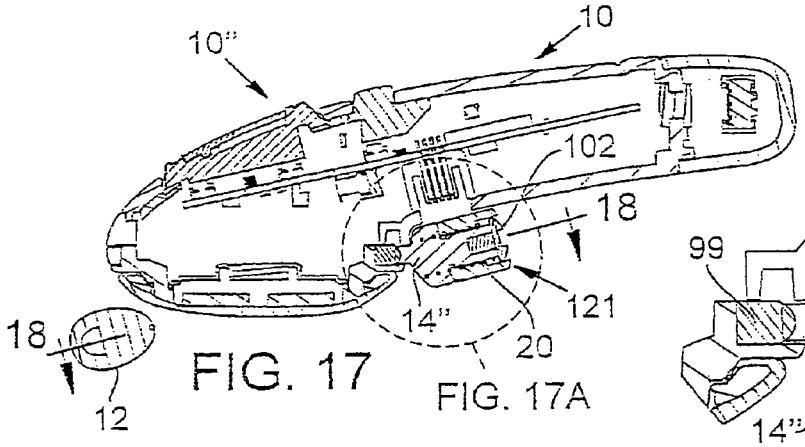
FIG. 17
FIG. 17A
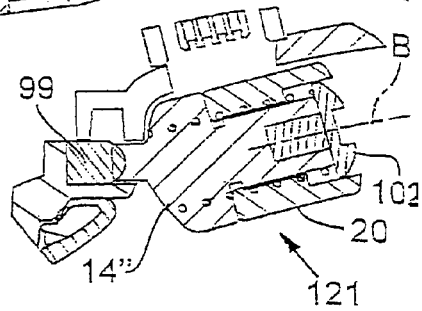
FIG. 17A
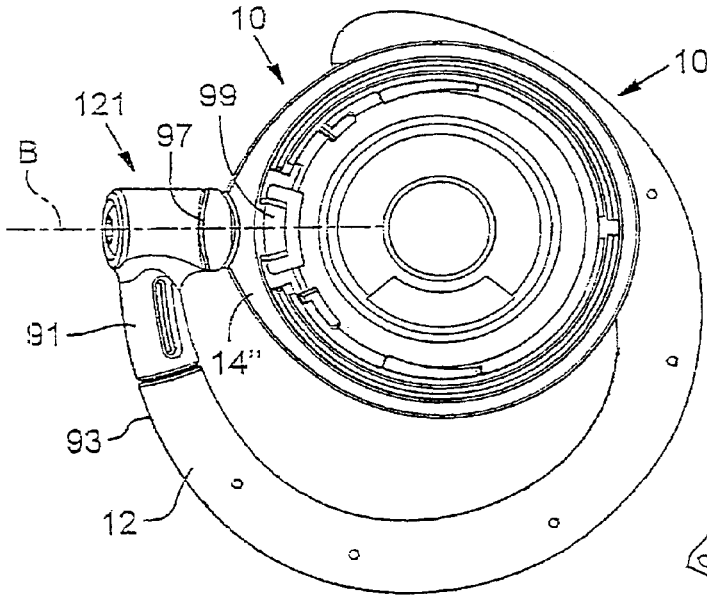
FIG. 18
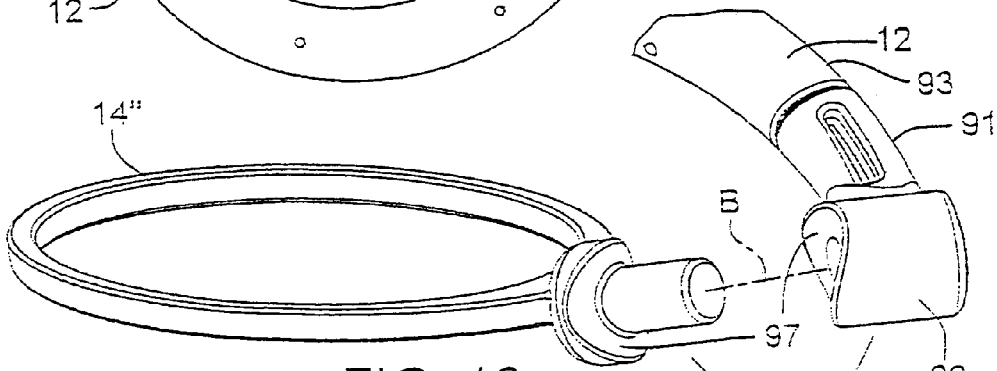
FIG. 19

PERSONAL AUDIO-SET WITH ADJUSTABLE SLIDING EAR CLIP MOUNT

CROSS-REFERENCE TO RELATED APPLICATIONS

This application is a continuation of U.S. patent application Ser. No. 11/031,695, filed on Jan. 7, 2005 now abandoned, which claims priority to U.S. Provisional Patent Application Ser. No. 60/535,055 filed on Jan. 7, 2004, the disclosures of which is hereby incorporated by reference.

FIELD OF THE INVENTION

The present invention relates to a personal audio set that includes an adjustable sliding ear clip mount.

BACKGROUND OF THE INVENTION

Personal audio-sets, commonly known as headphones, earphones, headsets, and the like, are gaining in popularity. The typical audio-set includes a frame containing an earphone which is usually positioned over or in a wearer's ear. In cases where the audio-set is a headset, a microphone is also typically positioned on the frame near the wearer's mouth.

It is important that the frame of the audio-set securely hold these components in their proper places with respect to the wearer, without being unduly heavy and without causing discomfort to the wearer. Historically, the frames of personal audio-sets have included a headband that the wearer positions over or behind their head to hold an earphone portion over one or both ears. However, some headband-type personal audio-sets inadvertently compress the wearer's head or ears thereby causing discomfort, particularly when the personal audio-set is worn for extended periods.

Personal audio-sets have been mounted to a wearer without using a headband. For example, some personal audio-set rely on ear plug-type mounts that are either physically wedged either into the wearer's ear canal or hooked on the intertragal notch of the wearer's ear as shown in U.S. Pat. No. 5,544,253 to Nagayoshi et al. However, the size of a wearer's ear and ear canal differ greatly between wearers. Accordingly, different sized ear plugs must typically be offered to account for these differences in ear and ear canal sizes. Moreover, since the entire weight of the assembly is supported by such a small portion of the ear, these types of mounts feel uncomfortable for some wearers.

More recently, headphones have been hooked around the base of a wearer's ear as shown in U.S. Pat. No. 5,625,171 to Marshall. However, these types of mounts are relatively bulky structures and some wearers feel discomfort supporting the personal audio-set in this matter. In addition, most ear hook designs do not easily lend themselves to being worn over either a wearer's left or right ear.

SUMMARY OF THE INVENTION

Accordingly, despite the available improvements offered by personal audio-set ear mounts, there remains a need for an ear clip type mount for a personal audio set that is light weight, not bulky, reversible without the need for a user to physically disconnect various components of the headset and is comfortable to wear in either the wearer's left or right ears. In addition to other benefits that will become apparent in the following disclosure, the present invention fulfills these needs.

The present invention is a personal audio set, such as a headphone, earphone, or headset that includes an ear-clip mounting portion that is reversible relative to the frame. In one disclosed embodiment, the ear hook is pivotally secured to the frame along a first axis so that the headset may be properly worn on either the wearer's left or right ear. This axis preferably extends through or near the center of the ear-engaging portion. The headset frame also preferably includes an ear hook-mounting portion that is slidably secured to the frame to allow the base of the ear hook to slide relative to the frame and thereby allow the user to adjust the position of the ear hook relative to the frame for optimal fit and comfort.

In one embodiment, the ear hook may be formed of a substantially rigid material to essentially define a spine of the ear hook, with more pliable, resilient, cushioning materials appended at key positions along the spine. These key locations preferably include positions along the spine where the user's ear and head contact the ear hook. More preferably, these two materials forming the ear hook are dual molded.

In another embodiment, a porous solid windscreen formed of metal, plastic or the like covers the microphone without the need for the familiar large foam ball of material over the microphone.

BRIEF DESCRIPTION OF THE DRAWINGS

FIG. 17 in a cross-sectional view of a possible attachment structure for pivotally securing the ear hook to the frame.

FIG. 17A is an enlarged, partial, cross-sectional view of the attachment structure of FIG. 17.

FIG. 18 is a cross-sectional view of the headset of FIG. 13 taken along line 18-18 of FIG. 17.

FIG. 19 is an enlarged isometric view of a portion of the attachment structure of FIG. 17.

DETAILED DESCRIPTION OF PREFERRED EMBODIMENTS

A personal audio set 10, such as a headphone, earphone, or headset, that includes an ear-clip 12 and an ear-clip mounting portion 14 that is slidably secured to a frame 16 so as to preferably slide substantially about a first axis A is disclosed in FIGS. 1-19.

Figure 1:
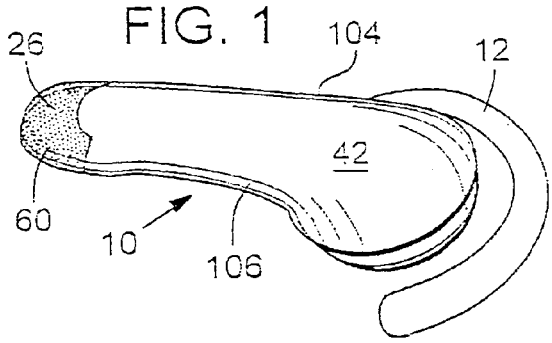
FIG. 1 is a bottom, left side, isometric view of a personal audio set having an ear hook portion slidably secured to a frame in accordance with an embodiment of the present invention.
Figure 2:
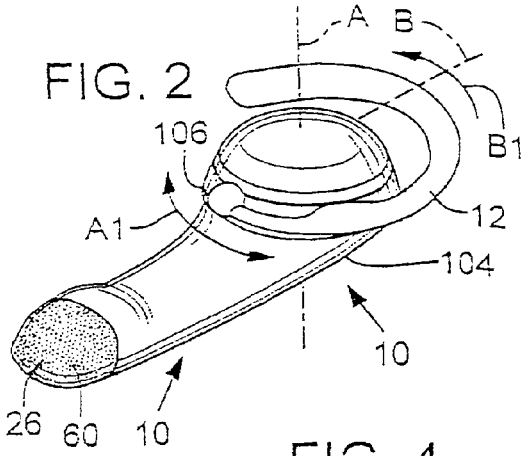
FIG. 2 is a top, right side, isometric view of the personal audio set of FIG. 1 showing a possible sliding movement of the hear hook about pivot axis A in the direction of arrows A1 and a possible pivoting movement of the hear hook about axis B in the direction of arrow B1.
Figure 3:
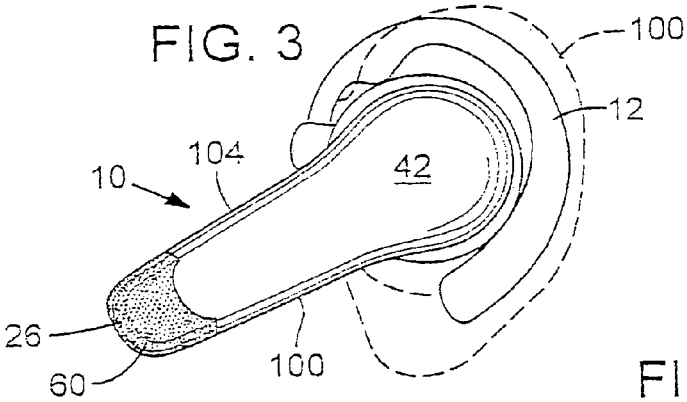
FIG. 3 is a left side view of the headset of FIG. 1 showing a possible installation on a user's left ear.
Figure 4:
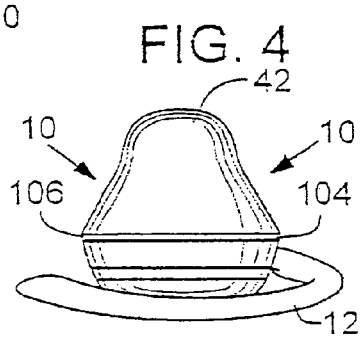
FIG. 4 is a back view of the headset of FIG. 1.
Figure 5:
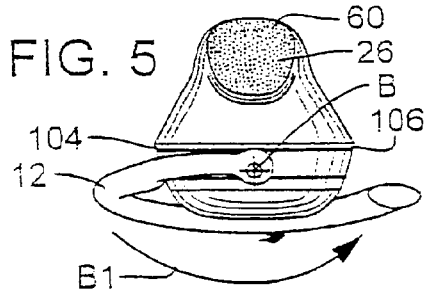
FIG. 5 is a front view of the headset of FIG. 1.
Figure 6:
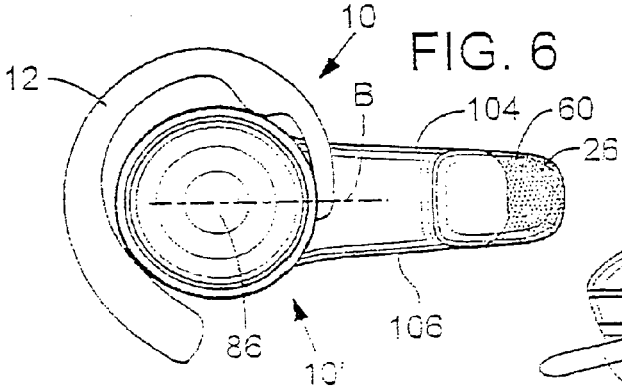
FIG. 6 is a right side view of the headset of FIG. 1.

In a preferred embodiment shown in FIGS. 1-12D, the ear clip 12 of the personal audio set 10 is also preferably pivotally secured to the ear-clip mounting portion 14 so as to pivot about a second axis B, and axis A and axis B are preferably aligned substantially orthogonally to each other as best shown in FIG. 2. Even more preferably, axis A is aligned substantially perpendicular to a plane defined by the outer edge of a wearer's ear when the personal audio set is being worn, and axis B is aligned substantially with this plane.

In a preferred embodiment shown in FIGS. 1-12D, the ear clip 12 of the personal audio set 10 is also preferably pivotally secured to the ear-clip mounting portion 14 so as to pivot about a second axis B, and axis A and axis B are preferably aligned substantially orthogonally to each other as best shown in FIG. 2. Even more preferably, axis A is aligned substantially perpendicular to a plane defined by the outer edge of a wearer's ear when the personal audio set is being worn, and axis B is aligned substantially with this plane.

The personal audio set. 10 of this embodiment is preferably a headset 10'. The ear clip 12 is preferably substantially c-shaped so as to mount around the base of a wearer's ear. A first end 20 of the ear clip 12 is pivotally secured to the ear clip mounting portion 14 defining axis B. The ear clip-mounting portion 14 is slidably secured to the frame 16 so as to define axis A.

The frame 16 includes an earphone portion 22 sized and shaped to operably engage a wearer's ear. An optional boom microphone portion 24 preferably extends from the frame 16. If so, it is desirable for the tip 26 of the boom microphone 24 to be either over or directed toward the wearer's mouth (not shown).

The earphone portion 22 preferably contains an earphone 30, and suitable wireless transmitting circuitry 32 is preferably contained within the frame 16 to permit wireless communication with a receiving device. Alternatively, wiring (not shown) extends from the headset 10' to operably connect the headset 10' to an appropriate audio device (not shown).

Figure 9:
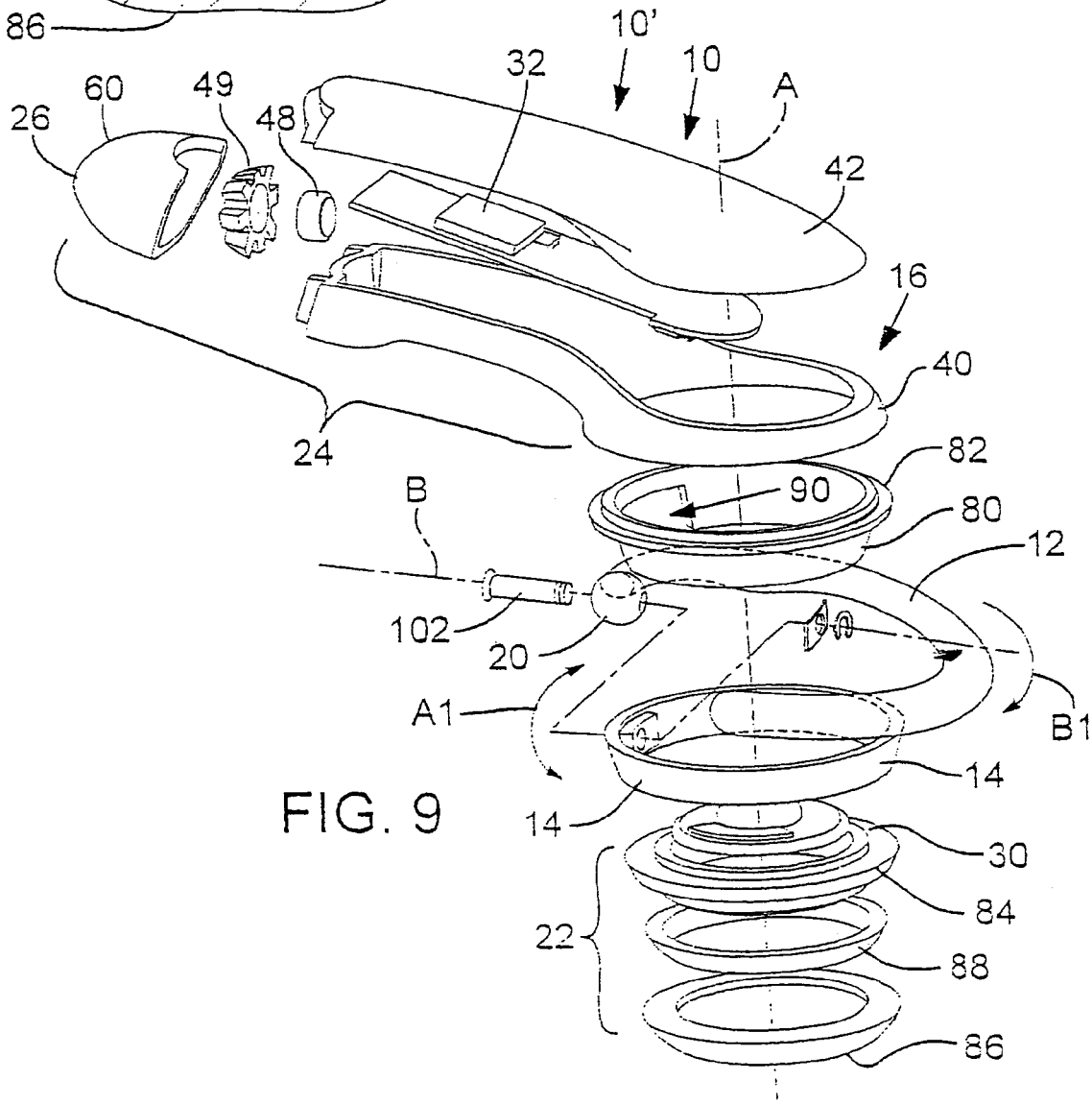
FIG. 9 is an exploded isometric view of the headset of FIG. 1.

Preferably and as best shown in FIG. 9, the frame 16 includes a base 40 with a cover 42 attached thereto to define an internal chamber 44 for receiving personal audio set electronics 46 and related components such as a microphone 48 and transmitter 50 therein. The base 40 and cover 42 preferably also define the boom microphone portion 24, and a suitable windscreen 60 is preferably positioned toward or at the tip 26 of the boom microphone portion 24.

More preferably, the windscreen 60 is formed of a porous solid material such as metal, polymer, plastic or the like thereby avoiding the need for a familiar large foam ball of material over the microphone. Preferably, the windscreen 60 is a monolithic structure formed by sintering the material so as to produce a relatively consistent and desired sized pore structure.

More preferably, the windscreen 60 is sintered while in a mold, thereby allowing it to be formed in a variety of form factors including substantially arcuate structures and the like to accommodate desired aesthetic and acoustic needs.

Figure 8:
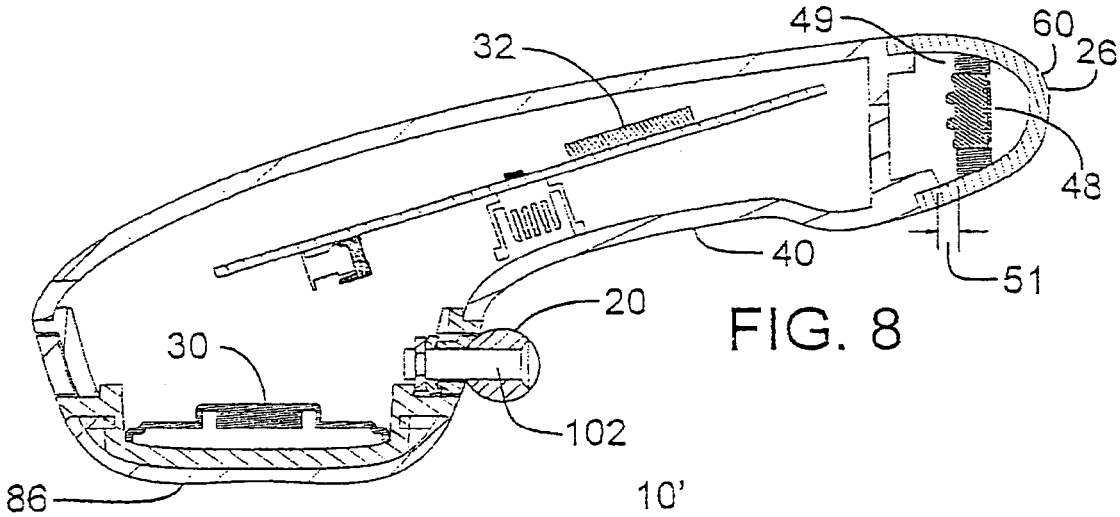
FIG. 8 is a sectional view of the headset of FIG. 1 taken along line 8-8 of FIG. 4.

Referring to FIG. 8, the windscreen 60 can substantially encircle the microphone 48, which is held in place by microphone support 49 preferably having a large number of vents therethrough. Preferably, the windscreen 60 extends over and past the microphone by a defined distance 51 of least 2 millimeters. Because of the acoustic transparency of the porous solid windscreen, the microphone is essentially suspended in substantially acoustic interference free space, thereby improving its sound capture characteristics of desirable sounds.

The ear clip-engaging portion 14 is preferably a ring 14' sized to rotate about the mating lip 80 of an engaging structure 82 that is secured to the frame 16. An opposite ear phone mounting portion 84 is connected to the engaging structure 82 so as to allow the ring 14' to rotate about the lip 80. The earphone-mounting portion 84 preferably includes the earphone 30 therein and a padded cover 86 with a related mounting ring 88.

Figure 10:
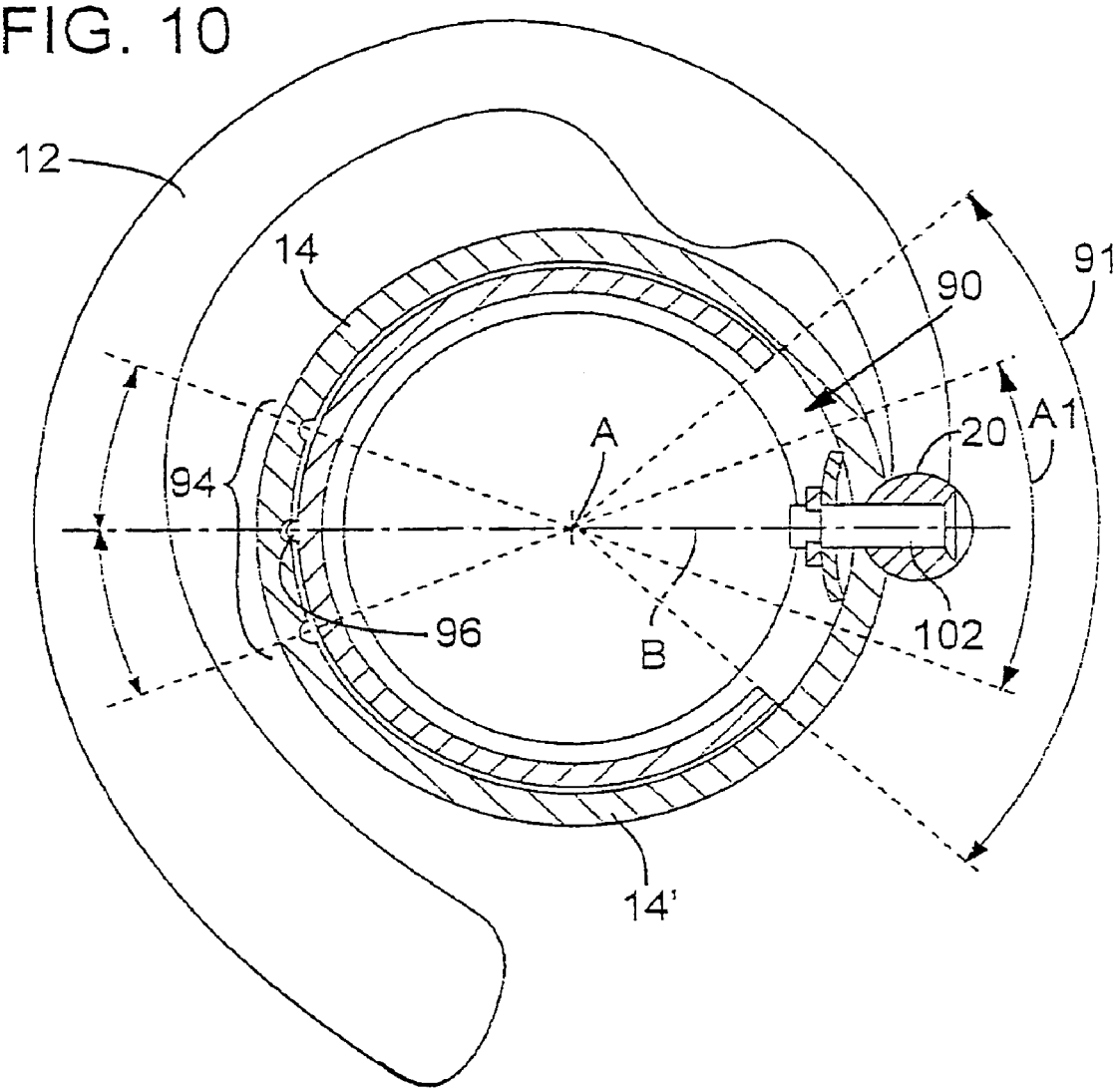
FIG. 10 is a sectional view of the headset of FIG. 1 taken along line 10-10 of FIG. 11F.
Figure 11A:
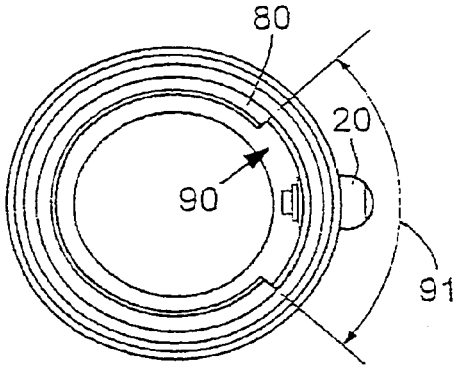
FIGS. 11A-F are various sectional views of portions of the headset of FIG. 1.
Figure 11B:
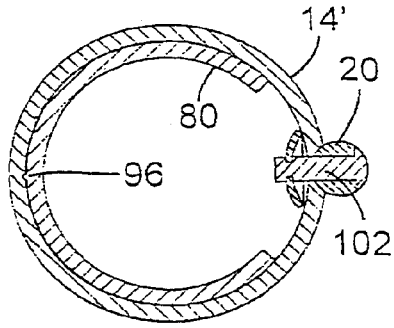
Figure 11C:
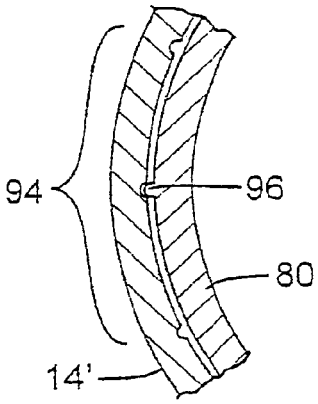
Figure 11F:
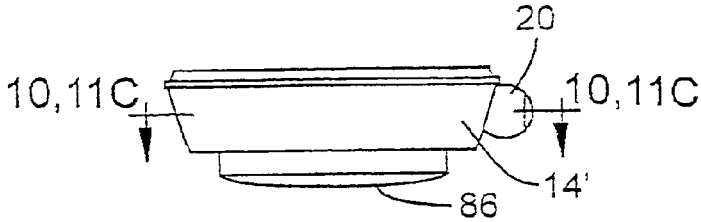
Figure 11D:
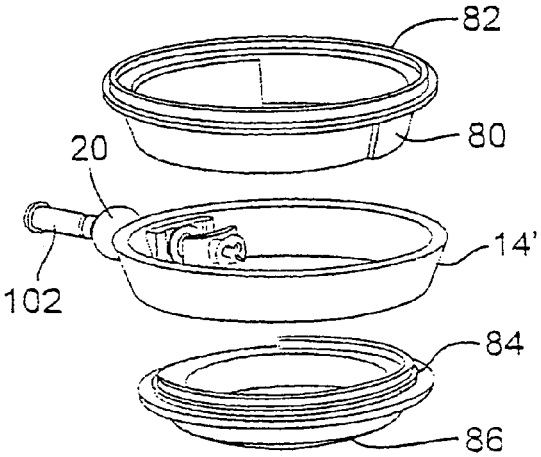
Figure 11E:
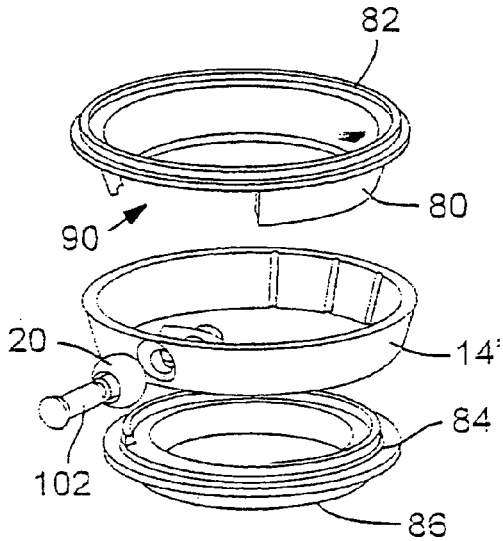
Figure 12A:
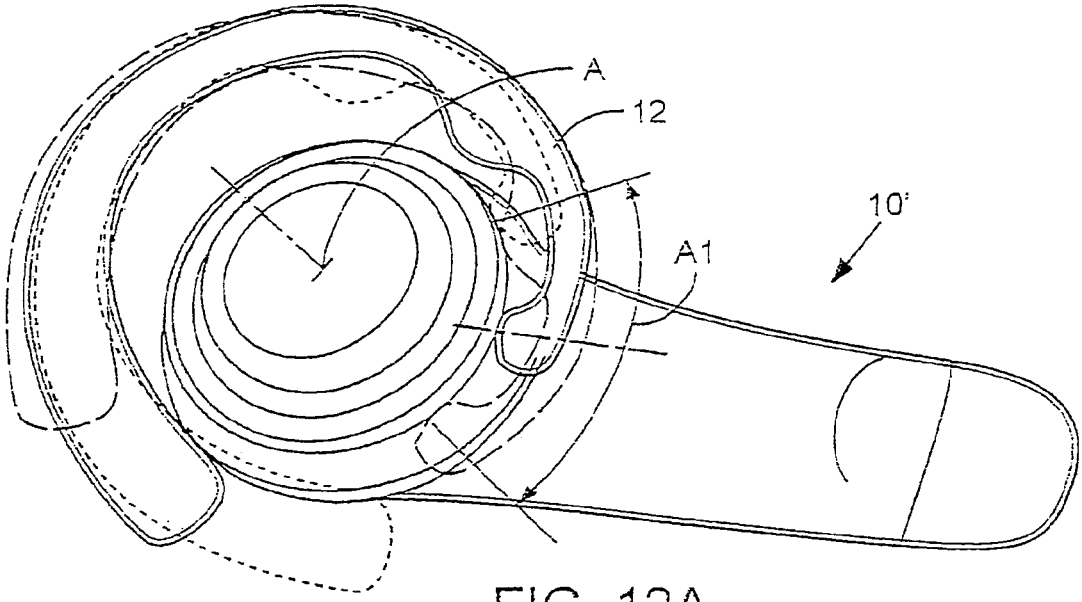
FIGS. 12A-D are various isometric views showing possible movement of the ear clip relative to the headset frame in accordance with an embodiment of the present invention.
Figure 12B:
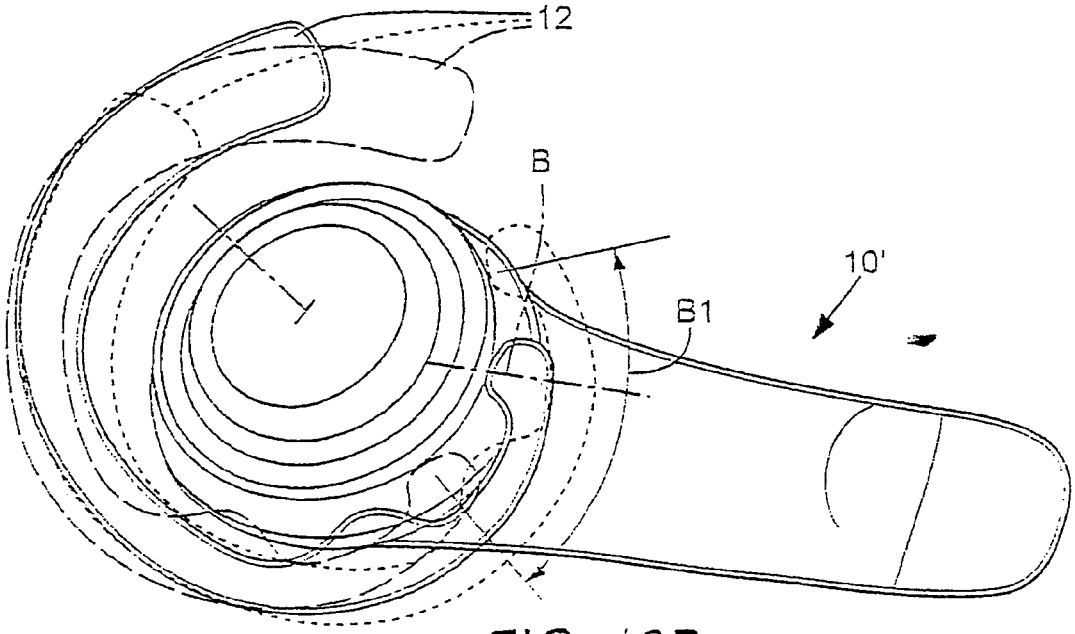
Figure 12C:
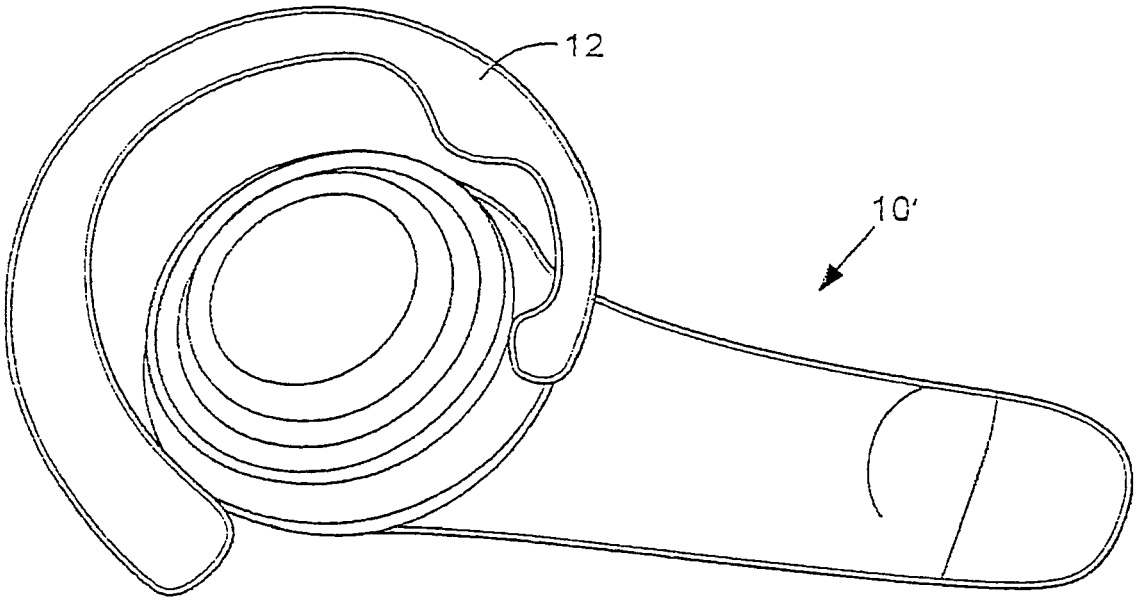
Figure 12D:
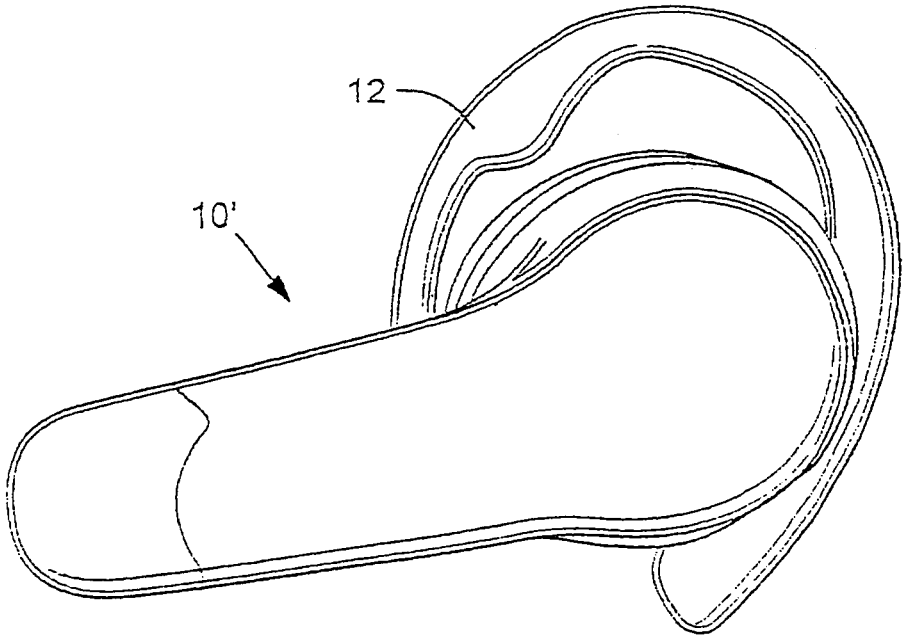
Figure 13:
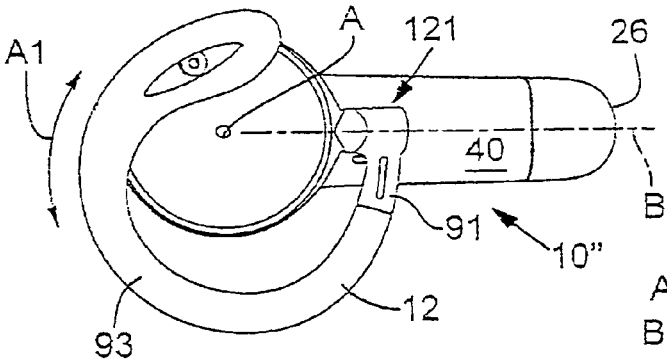
FIG. 13 is a right side view of an alternative embodiment headset.
Figure 14:
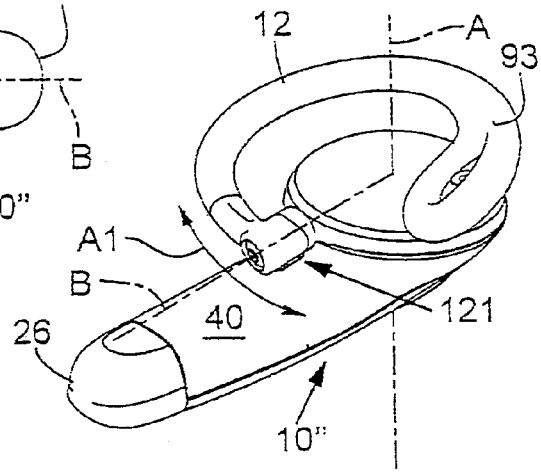
FIG. 14 is a top, right side isometric view of the headset of FIG. 13.

Preferably, the engaging structure 82 includes an opening 90 sized to limit the range of movement of the ring 14'. More preferably and as best shown in FIG. 10, this range of movement 91 is about plus or minus 25 degrees from the center 92 of the opening 90. More preferably and as best shown in FIG. 11*c*, a plurality of spaced-apart, resistive detents 94 are provided along the engaging surfaces between the ring 14' and lip 80 so as to allow a protrusion 96 extending from the lip 80 to hold the ring 14' at a desired position relative to the frame 16. Accordingly, a user may position the ear clip. 12 relative to the frame 16 along axis A so as to properly align the boom microphone portion 24 and optimize wearer comfort.

Figure 7:
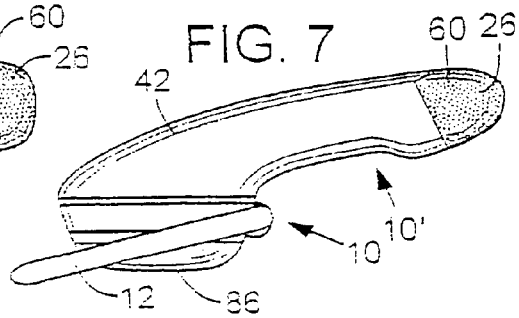
FIG. 7 is a top view of the headset of FIG. 1.

Preferably and as shown in FIG. 9, first end 20 of the ear clip 12 is pivotally secured to the ear clip mounting portion 14 with a pivot pin 102, thereby defining pivot axis B and allowing the ear clip 12 to move about pivot axis B in the direction of arrow B1 (FIGS. 2, 7 and 9). More preferably, the ear clip 12 pivots about axis B so as to move, or flip, about the frame 16 and thereby allow the ear clip 12 to be positioned along either the top edge 104 or bottom edge 106 of the frame. Accordingly, the personal audio set may be worn in either the wearer's left or right ears depending on how the ear clip 12 is positioned relative to the frame 16. Preferably, resistive detents are provided between the first end 20 of the ear clip and the ring 14' so as to hold a desired position of the ear clip 12 about the axis B relative to the frame 16.

Figure 15A:
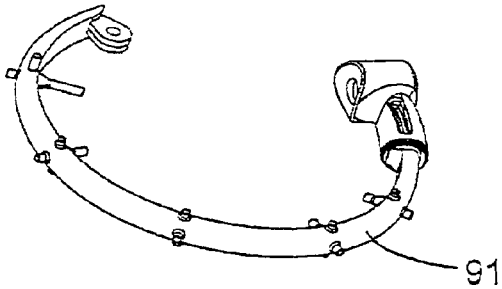
FIG. 15A is an isometric view of a spine portion of an ear hook in accordance with an embodiment of the present invention.
Figure 15B:
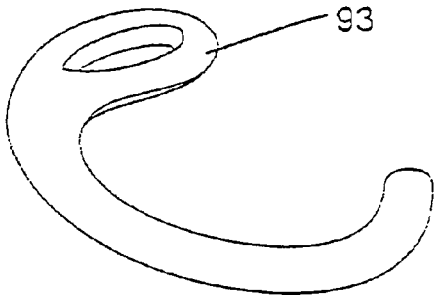
FIG. 15B is an isometric view of an over-molded portion of an ear hook in accordance with an embodiment of the present invention.
Figure 15C:
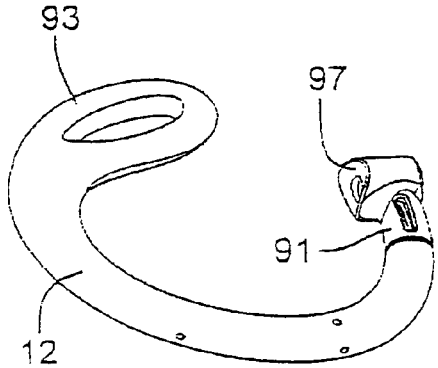
FIG. 15C is the spine and over-molded portions of the ear hook of FIGS. 15A and 15B-showing a possible assembled configuration.
Figure 16:
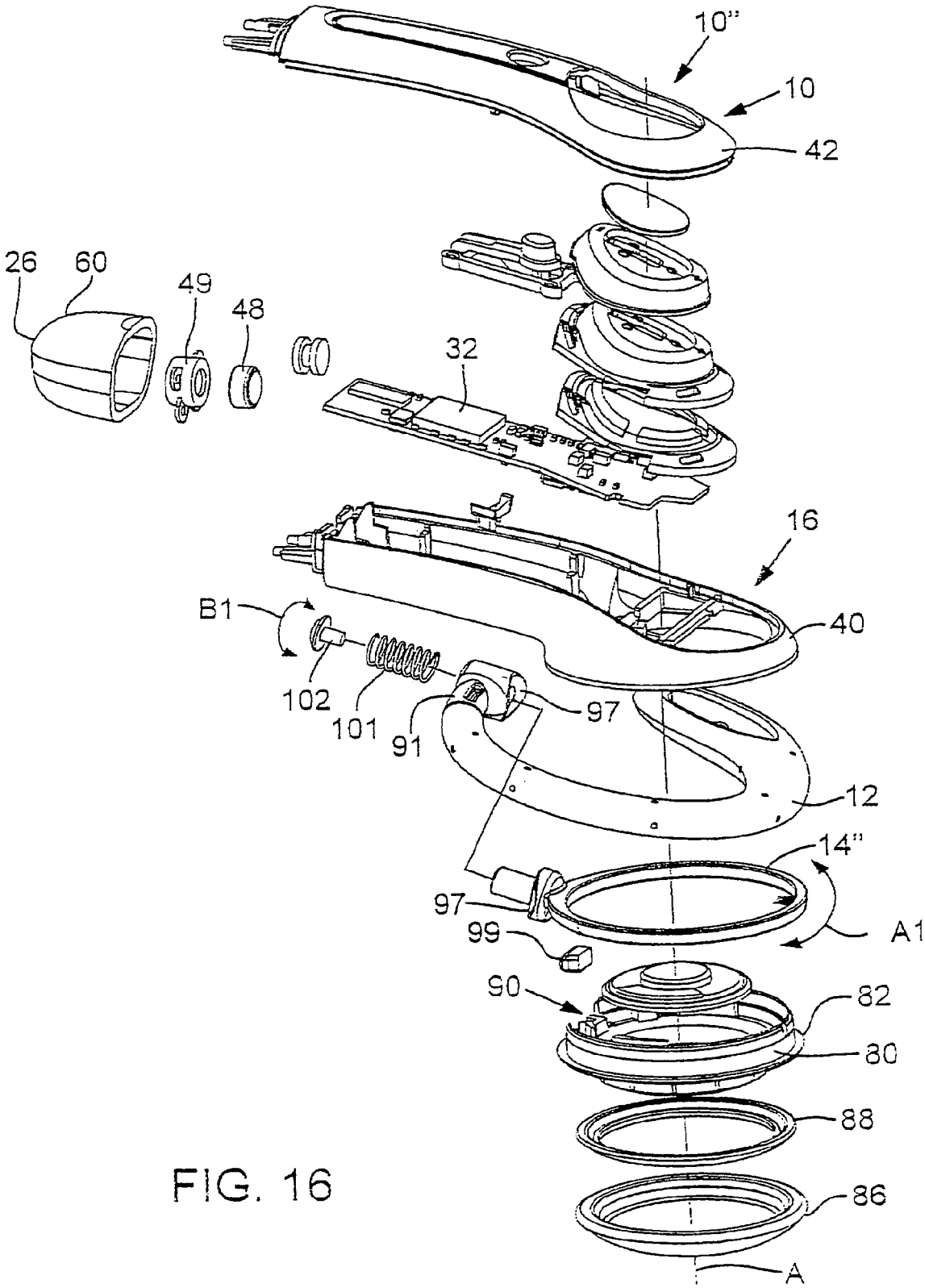
FIG. 16 is an exploded isometric view of the headset of FIG. 13.

Preferably, the ear hook 12 may be formed of a substantially rigid material to essentially define a spine (91, FIG. 15A) of the ear hook, with more pliable, resilient, cushioning materials appended at key positions along the spine. These key locations preferably include positions along the spine where the user's ear and head contact the ear hook. More preferably, these two materials forming the ear hook are dual molded to define the spine 91 (FIG. 15A) and an over-molded more pliable cushioning material 93 (FIG. 15B) that are joined together as best shown in FIG. 15C. Known possible rigid materials for the spine include polycarbonate such as one sold by the General Electric Corporation under the trade name LEXAN EXRL 0050. A possible over-mold material is Silicone Rubber Base, Shore 50A. Of course, other materials could be used as needed.

A user mounts the personal audio set 10 to their ear 100 by positioning the ear clip 12 at a desired location about axis B for so as to allow the clip to fit over and behind either the user's left or right ear with the ear phone 30—positioned substantially adjacent to the ear canal of the user. The user can the adjust the position of the boom microphone portion about axis A by sliding the frame 16 relative to the ear clip 12 substantially about axis A.

B. Alternative Preferred Embodiment

An alternative preferred embodiment of a personal audio set 10" of the present invention is disclosed in FIGS. 13-19. In order to avoid undue repetition, like elements between the personal audio set 10" and 10' are like numbered.

In particular, an alternative preferred pivoting structure 121 for securing the ear hook to the frame is disclosed. The first end 20 of the ear clip 12 is pivotally secured to the ear clip-mounting portion 14 with pin 102. The first end 20 and the ring 14" both include a smoothly arcuate concave and convex surface 97 as best shown in FIG. 19 that intermesh so as to bias the ear clip to a defined position relative to the frame. More preferably, a biasing force, such as that applied by compression spring 101, urges the ear clip to the defined position which still allowing the ear clip to be positioned and moved as needed to optimize wearer comfort.

More preferably, a friction pad 99 is also operably secured between the ring and sliding surface of the frame so as to resist movement of the ring on the frame after a user has selected a desired position of the ear hook relative to the frame. Accordingly, the ring 14" can rotate 360 degrees about axis A without the need for resistive detents along the engaging surface.

Having described and illustrated the principles of our invention with reference to a preferred embodiment thereof, it will be apparent that the invention can be modified in arrangement and detail without departing from such principles. For example, two personal audio sets 10 can be secured, one each, in both the right and left ears of the wearer, thereby providing stereo sound to the wearer, and allowing the two personal audio sets to operate like a pair of headphones. Preferably in such case, none or only one of the personal audio sets includes boom microphone extending therefrom.

Also, the sliding ear hook, porous wind screen and dual composition ear hook elements of the disclosed preferred embodiment may be individually installed on a personal audio set as needed and desired for a particular application.

In view of the many possible embodiments to which the principles may be put, it should be recognized that the detailed embodiment is illustrative only and should not be taken as limiting the scope of our invention. Accordingly, we claim as our invention all such modifications as may come within the scope and spirit of the following claims and equivalents thereto.

We claim:

1. A personal audio set comprising:

a frame including an upper portion and a mating lip having a first end and a second end, said second end of the mating lip operably secured to the upper portion;

an earphone mounting portion operably secured to said first end of said mating lip, said earphone mounting portion having a fixed position relative to said mating lip;

an earphone operably secured within said earphone mounting portion;

a sliding portion positioned between said upper portion and said earphone mounting portion, said sliding portion slidably secured to said mating lip so as to move about a first pivot axis; and, an ear hook having a first end and an opposite second end, and pivotally secured by a pivot pin to the sliding portion so as to define a second pivot axis, wherein the ear hook is capable of rotating only around said second pivot axis;

wherein said first pivot axis and said second pivot axis are spaced apart from each other.

2. The personal audio set of claim 1, wherein said first pivot axis and said second pivot axis are substantially perpendicular to each other.

3. The personal audio set of claim 1, wherein said earphone defines an ear plane, and said first pivot axis is substantially perpendicular to said ear plane.

4. The personal audio set of claim 1, wherein said ear hook is substantially c-shaped, and said personal audio set may be worn on either a wearer's left or right ear.

5. The personal audio set of claim 1, wherein said personal audio set is a headset having a boom microphone extending therefrom.

6. The personal audio set of claim 1, wherein said frame has a plurality of resistive detents form operably engaging the sliding portion at defined locations.

7. The personal audio set of claim 1, further including a friction pad between a sliding surface of said frame and said sliding portion to resist movement of the sliding portion relative to said frame.

8. The personal audio set of claim 1, wherein said ear hook is dual molded.

9. The personal audio set of claim 1, wherein said ear hook has a substantially rigid spine and resilient upper portion.

10. The personal audio set of claim 1, further including a biasing structure between said ear hook and said sliding portion for biasing said ear hook to a neutral position.

11. The personal audio set of claim 10, wherein said biasing structure includes a compression spring extending between said ear hook and said sliding portion.

12. The personal audio set of claim 10, wherein said biasing structure further includes a smoothly arcuate concave and convex surface on said sliding portion and a smoothly arcuate mating concave and convex surface on said first end of said ear hook, and said concave surface and convex surface operably engage each other in said neutral position.

13. The personal audio set of claim 1, wherein the sliding portion is a ring and the first end of the ear hook is pivotally secured to the sliding portion with a pivot pin.

14. A personal audio set comprising:

a frame including an upper portion and a mating lip having a first end and a second end, said second end of the mating lip operably secured to the upper portion;

an earphone mounting portion operably secured to said first end of said mating lip, said earphone mounting portion having a fixed position relative to said mating lip;

an earphone operably secured within said earphone mounting portion;

a ring positioned between said upper portion and said earphone mounting portion, said ring so as to rotate about a first pivot axis;

an ear hook having a first end and an opposite second end;

a pivot pin connecting the first end of said ear hook to said ring, said ear hook rotating around a second axis through said pin, wherein the ear hook is capable of rotating only around said second pivot axis;

wherein said first pivot axis and said second pivot axis are spaced apart from each other.

* * * * *